US005103709A

United States Patent [19]

Foss, Jr.

[11] Patent Number: 5,103,709

[45] Date of Patent: Apr. 14, 1992

[54] PROTECTIVE DEVICE FOR MUSICAL INSTRUMENTS

[76] Inventor: Richard A. Foss, Jr., 2433 NW. 19th Ter., Fort Lauderdale, Fla. 33305

[21] Appl. No.: 524,258

[22] Filed: May 15, 1990

[51] Int. Cl.[5] ..... G10D 3/00; G10G 5/00

[52] U.S. Cl. ..... 84/327; 84/453

[58] Field of Search ..... 84/453, 278, 279, 327, 84/328; 206/314; 150/162

[56] References Cited

U.S. PATENT DOCUMENTS 1,570,361 1/1926 Wallace ..... 84/279
1,785,206 12/1930 Overton ..... 84/328
3,251,258 5/1966 Parker ..... 150/162 X
3,877,501 4/1975 Toth ..... 206/313
4,084,477 4/1978 Dominguez ..... 84/327
4,601,391 7/1986 Gibbs et al. ..... 84/453 X
4,951,541 8/1990 McMillan ..... 84/280

*Primary Examiner*—Brian W. Brown
*Attorney, Agent, or Firm*—Saliwanchik & Saliwanchik

[57] ABSTRACT

A novel device for protecting the finish of stringed instruments is described. The device comprises a soft, pliable material affixed to a rigid support. The device is in a shape which can be applied to various locations on a stringed instrument which needs protection. Advantageously, the device can be easily applied to and removed from the stringed instrument.

2 Claims, 3 Drawing Sheets

PROTECTIVE DEVICE FOR MUSICAL INSTRUMENTS

DESCRIPTION

BACKGROUND OF THE INVENTION

Musical instruments are not only valued for their ability to produce pleasing sounds, but, often, for their appearance as well. Unfortunately, because of their utility as musical devices, instruments cannot realistically be stored away from any threat of damage to the appearance. Often in the course of transporting instruments, scratches or dents can be incurred. Also, while the instruments are being played, they may be scratched or scraped. This is particularly true in the case of stringed instruments, which often have a cherished finish. As a result of the movement of the hands, pick, or bow, scratches are often difficult to avoid. Also, articles of clothing such as buttons, tie-tacks, cuff links, and belt buckles can inadvertently cause unsightly damage to these instruments. Jewelry such as rings, chains, and pendants may also cause damage.

The object of this invention is to provide a convenient means to protect the finish of a musical instrument from unsightly damage. The invention is specifically suited for the protection of the finish on stringed instruments. Although attempts have been made in the past to provide protective coverings, no appropriate product has been developed. For example, the appearance of the protective jacket described in U.S. Pat. No. 3,877,501, issued to John S. Toth, is probably worse than if the instrument were scratched. Furthermore, the Toth device fits only a few instruments which have the right shape, and it does not protect against pick or bow marks. A device similar to the Toth device is described in U.S. Pat. No. 4,601,391, issued to Gibbs et al. Like the Toth device, the Gibbs et al. device does not protect against abrasions to the front of an instrument, only fits instruments with certain shapes, is not particularly durable, and is generally unattractive.

BRIEF SUMMARY OF THE INVENTION

The subject invention comprises a reinforced pad, or combination of pads, designed to protect the finish of stringed instruments from scratches, abrasions, and general wear and tear. The pad can be used to add comfort to the player of the instrument, and it also hides existing imperfections in the finish of the instrument.

A preferred embodiment of the invention comprises a soft, pliable material attached to a rigid support. Generally the soft, pliable material is a foam padded fabric, but a variety of materials can be used. The rigid support is generally made from polystyrene plastic, but other analogous materials can also be used.

The pad can be detachably applied to the surface of the instrument by the use of VELCRO® attachments or other suitable means of attachment. The pads are made to conform to the size and shape of the pertinent musical instrument. Typically, the pad will be applied to the backs of acoustic or electric guitars. The presence of the pad will prevent scratches from belt buckles and buttons, and will make holding the guitar more comfortable for the performer. Also, it can prevent the instrument from slipping and sliding during use. This feature is especially useful for roundback guitars.

The pad can also be affixed in appropriate locations on the front of the guitar so as to prevent scratches from the use of a guitar pick.

The pads can be detached when not in use, and do not affect the quality of the sound produced by the instrument. Also, the pads do not detract from the appearance of the instrument and help to keep the finish of the instrument unblemished.

DETAILED DESCRIPTION OF THE INVENTION

Figure 1:
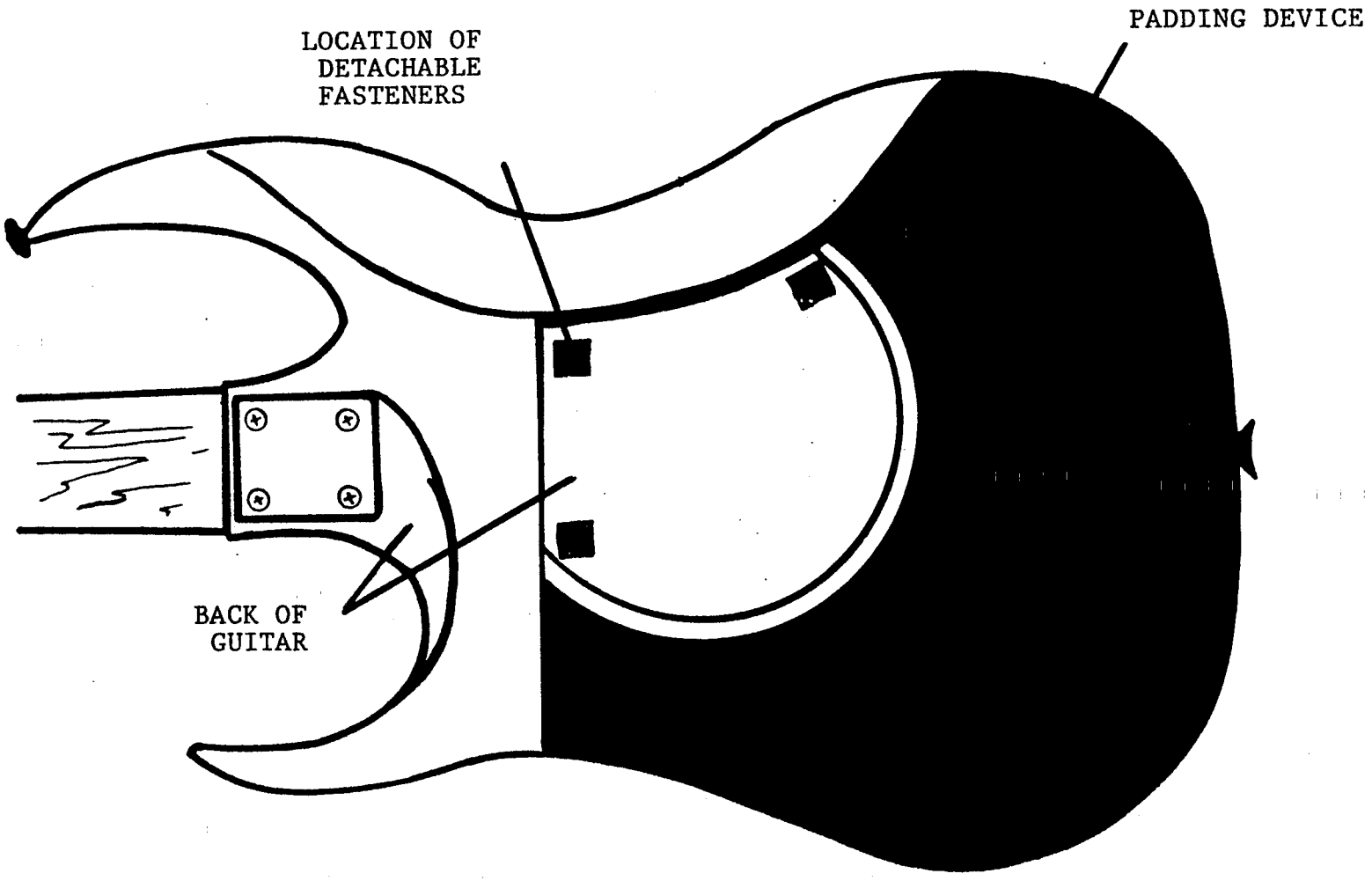
FIG. 1 shows the novel padding device affixed to the back of a guitar.
Figure 2A:
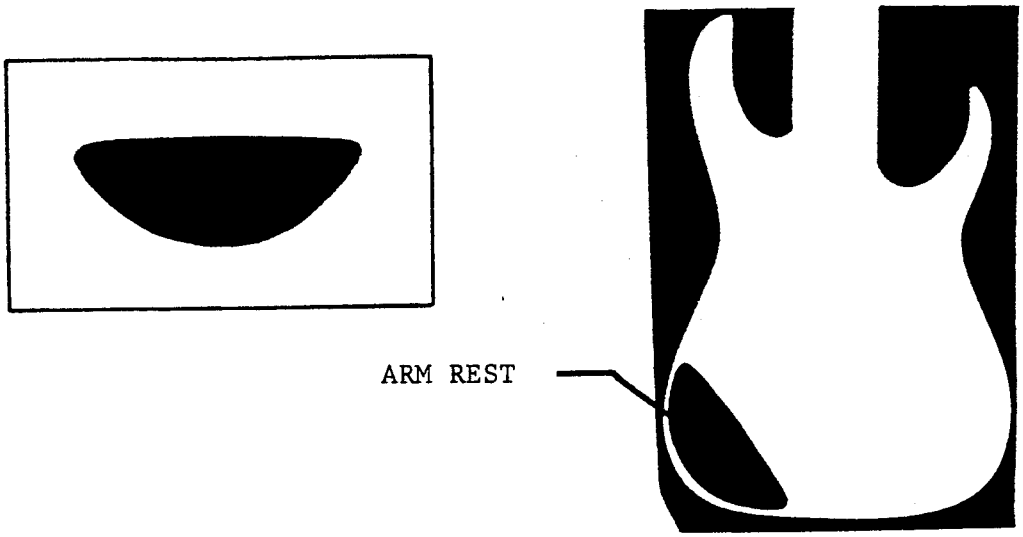
FIGS. 2A–2C show various shapes and placements of the novel padding device.
Figure 2B:
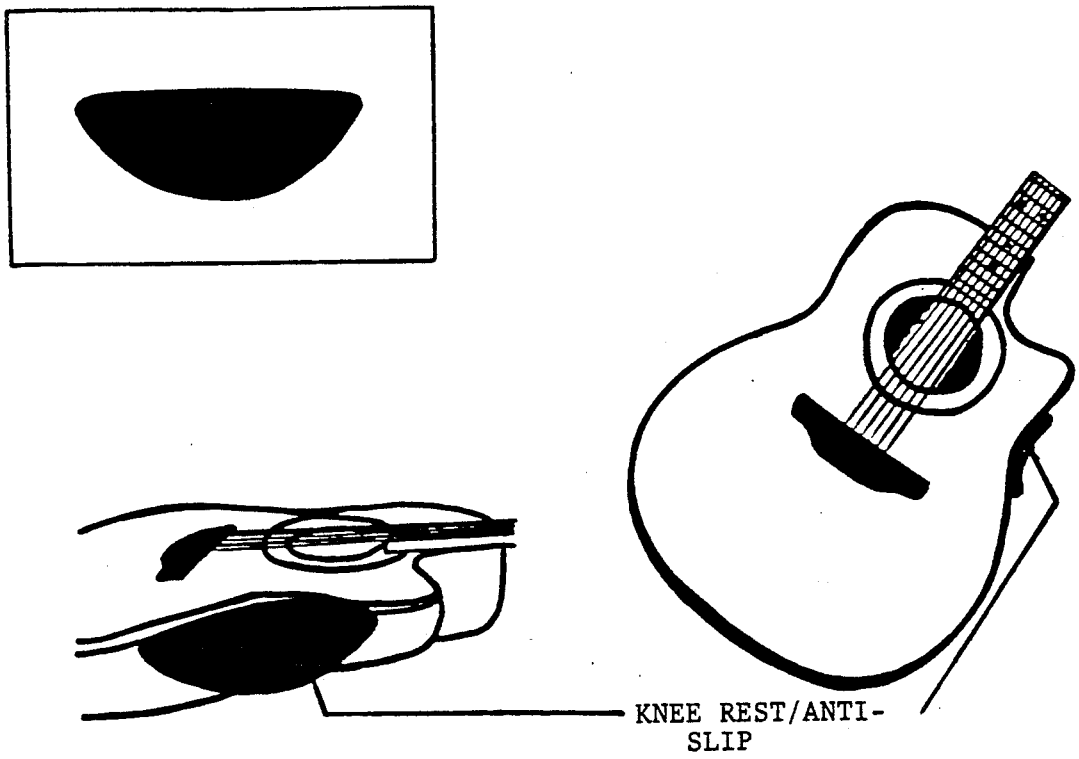
Figure 2C:
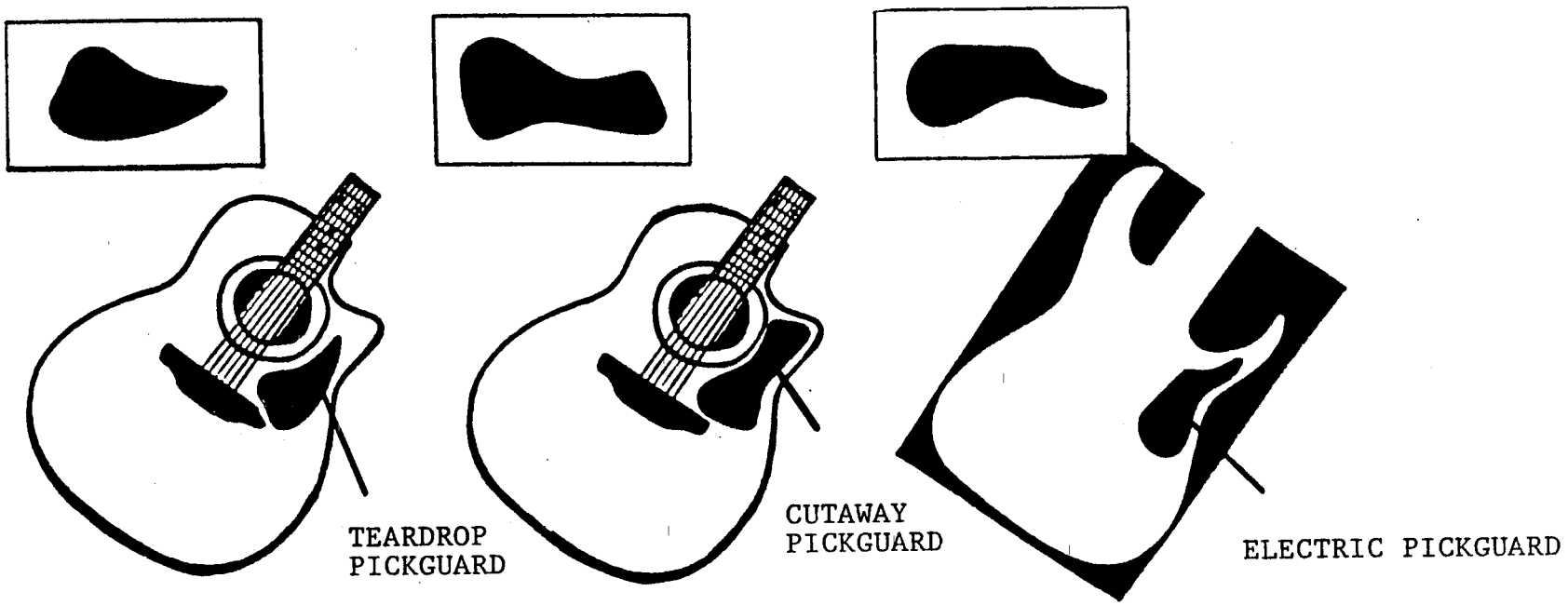

The subject invention pertains to pads which are detachably affixed to stringed instruments for the purpose of protecting the finish of these instruments. Generally, the pads will be applied to the entire back of an instrument and/or portions of the front of the instrument which must be protected from, for example, scratches caused by a guitar pick.

In a preferred embodiment, the pads comprise a soft, pliable material attached to a more rigid support. The soft, pliable material of the subject invention can be foam padded fabric. This material is also known to those skilled in the art as automotive headliner material. Other materials can be used instead of the foam padded fabric. Alternative materials include, but are not limited to, felt, velvet, terrycloth, leather, vinyls, nylon, polyester weaves, cotton weaves, and blended weaves.

In a preferred embodiment, the soft, pliable material is cut into the appropriate shape for the musical instrument of interest and the material is then wrapped around, or otherwise affixed, to a rigid support which gives the padding device durability and a constant shape. The rigid support may be, for exmaple, polystyrene plastic. Other materials which can be used instead of polystyrene plastic for the rigid support include various polymer materials, expanded PVC sheet, polycarbonate sheet, acrylic, cardboard, or pressed board. In a preferred embodiment of the subject invention, foam padded material is affixed by glue to one side of a polystyrene support. VELCRO® attachments are applied to the other side of the support. These VELCRO® attachments can then be detachably affixed to corresponding attachments placed on the musical instrument. Any means of detachable fastening can be used in place of the VELCRO® attachments described above. For example, double faced tape, screws, buttons, snaps, and suction cups could be used to detachably affix the pad device to the musical instrument.

The padding device described here can be made in the shape of the back of any stringed musical instrument. Also, pads can be made to affix at virtually any place on the musical instrument where protection against scratches or dents is needed. The pad also can protect against damage from skin oil and perspiration. Furthermore, the pads can prevent slippage of the instrument and make the instrument more comfortable to use. The pad does not alter the acoustic sound of the instrument. Advantageously, the pad can be easily removed, facilitating easy access to guitar's electronics and tremolo springs.

It should be understood that the descriptions and embodiments set forth above are for illustrative purposes only and that various modifications or changes in light thereof will be suggested to persons skilled in the art and are to be included within the spirit and purview of this application and the scope of the appended claims.

I claim:

1. A padding device for protecting the finish of stringed instruments, said device consisting of a soft, pliable foam-padded fabric attached to a thin, unilayer, non-flexible, rigid support wherein said rigid support is manufactured from a material selected from the group consisting of polystyrene, PVC, polycarbonate, acrylic, cardboard, and pressed board; wherein said thin, unilayer, rigid support with attached foam padded fabric is of appropriate size to be attached to the surface of a stringed instrument; and wherein said rigid support with attached foam padded fabric is in the shape of the area of the instrument which is to be protected, said device further comprising means for detachably affixing said device to said stringed instrument.

2. The padding device, according to claim 1, wherein said device is in the shape of, and fits onto, the back of an electric guitar.

* * * * *